US007762377B2

(12) United States Patent
Zug et al.

(10) Patent No.: US 7,762,377 B2
(45) Date of Patent: Jul. 27, 2010

(54) TRANSPORT CAR FOR METAL COILS

(75) Inventors: Josef Zug, Monheim (DE); Peter de Kock, Oberhausen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 643 days.

(21) Appl. No.: 10/536,683

(22) PCT Filed: Oct. 30, 2003

(86) PCT No.: PCT/EP03/12036

§ 371 (c)(1),
(2), (4) Date: May 27, 2005

(87) PCT Pub. No.: WO2004/050272

PCT Pub. Date: Jun. 17, 2004

(65) Prior Publication Data

US 2006/0045697 A1 Mar. 2, 2006

(30) Foreign Application Priority Data

Nov. 30, 2002 (DE) ..... 102 56 011

(51) Int. Cl.
*B66F 9/06* (2006.01)

(52) U.S. Cl. ..... 187/269; 414/589

(58) Field of Classification Search ..... 414/279, 414/282, 589; 187/269
See application file for complete search history.

(56) References Cited

U.S. PATENT DOCUMENTS 3,341,042 A * 9/1967 Carder ..... 414/471
3,370,727 A * 2/1968 Shaw ..... 414/495
3,534,664 A * 10/1970 Ulinski ..... 92/146
3,619,007 A * 11/1971 Phillips ..... 414/471
3,730,366 A * 5/1973 Berends ..... 414/495
3,991,951 A 11/1976 Galletti
RE29,542 E * 2/1978 Richards ..... 187/269
4,157,743 A * 6/1979 Masuda et al. ..... 182/141
4,175,644 A * 11/1979 Sikli ..... 187/269
4,312,619 A * 1/1982 Anderson et al. ..... 414/347
4,363,380 A * 12/1982 Rued et al. ..... 187/274
4,971,508 A * 11/1990 Miyahara et al. ..... 414/282
5,072,588 A * 12/1991 Lowder et al. ..... 60/571
5,636,713 A * 6/1997 Perkins et al. ..... 187/274
6,223,885 B1 * 5/2001 Markiewicz ..... 198/463.3

FOREIGN PATENT DOCUMENTS

| | | |
|---|---|---|
| DE | 2 200 212 | 7/1973 |
| DE | 29 18 848 | 8/1980 |
| EP | 0 016 898 | 10/1980 |
| EP | 0 061 557 | 10/1982 |
| EP | 0 569 719 | 11/1993 |
| WO | 99/12672 | 3/1999 |

* cited by examiner

*Primary Examiner*—James Keenan
(74) *Attorney, Agent, or Firm*—Friedrich Kueffner

(57) ABSTRACT

A transfer car in a conveyance system for metal coils, having a support saddle, a chassis that can be moved along a conveyance path by a drive and a mechanism for raising and lowering the support saddle along a linear vertical guide on a plate-like base frame. A steel slab is used as the plate-like base frame, on which a scissor unit is mounted for the purpose of linear vertical guidance and so as to not take on any lifting forces. Two lifting cylinders are installed some distance apart as the drive and act directly on the support saddle to provide the sole lifting forces to raise and lower the support saddle.

6 Claims, 10 Drawing Sheets

2
6
5
4
3
8
7
7
11
11
10
9
Hydraulics

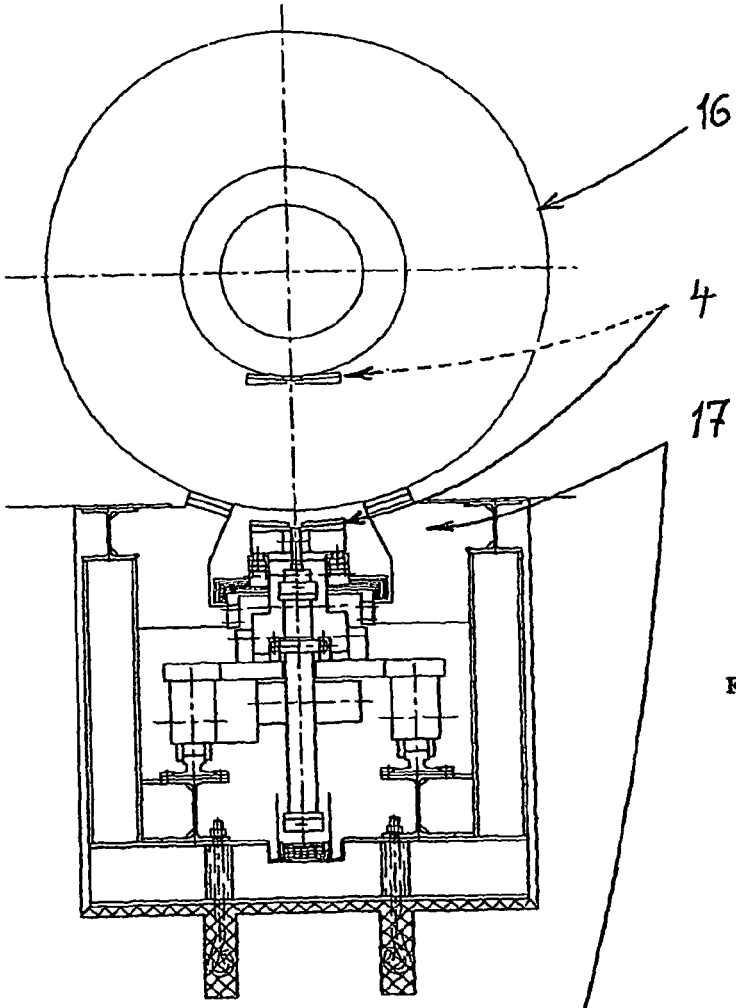
Fig. 7
Fig. 8
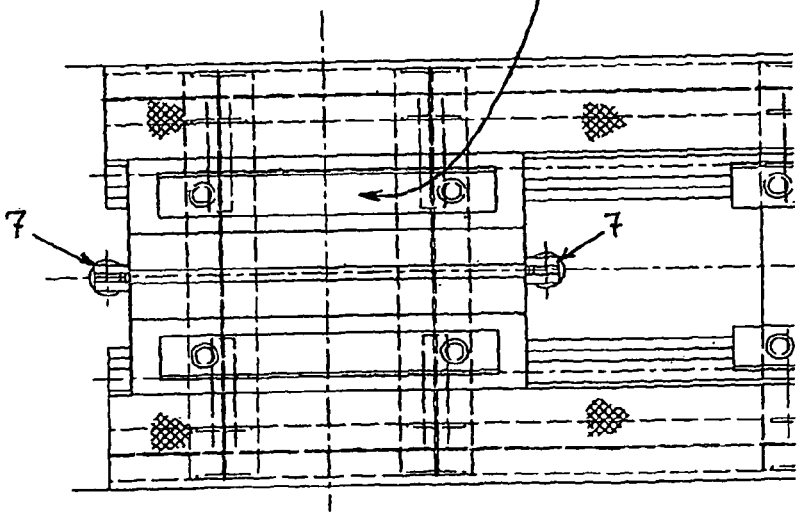

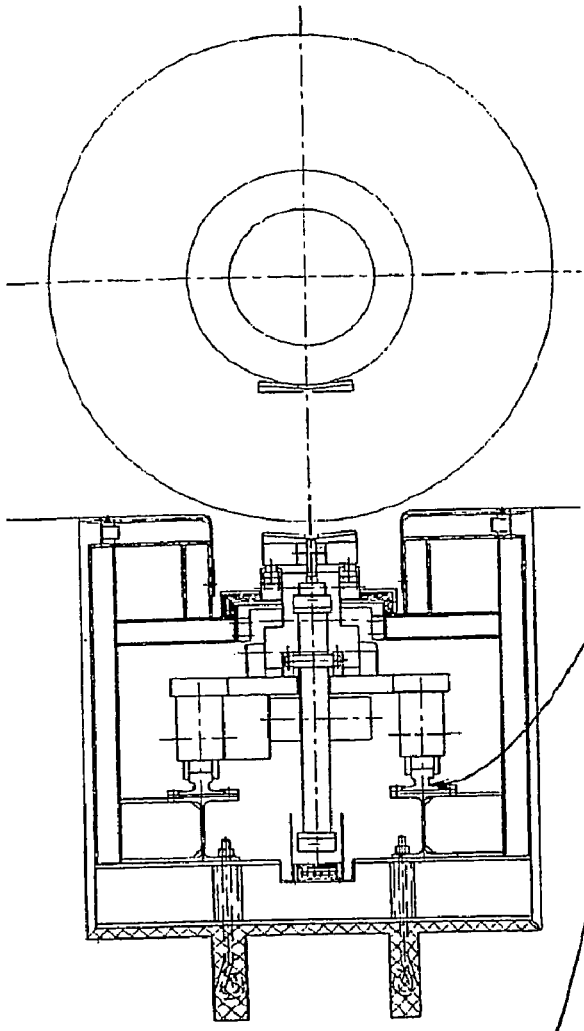
Fig. 11
Fig. 12
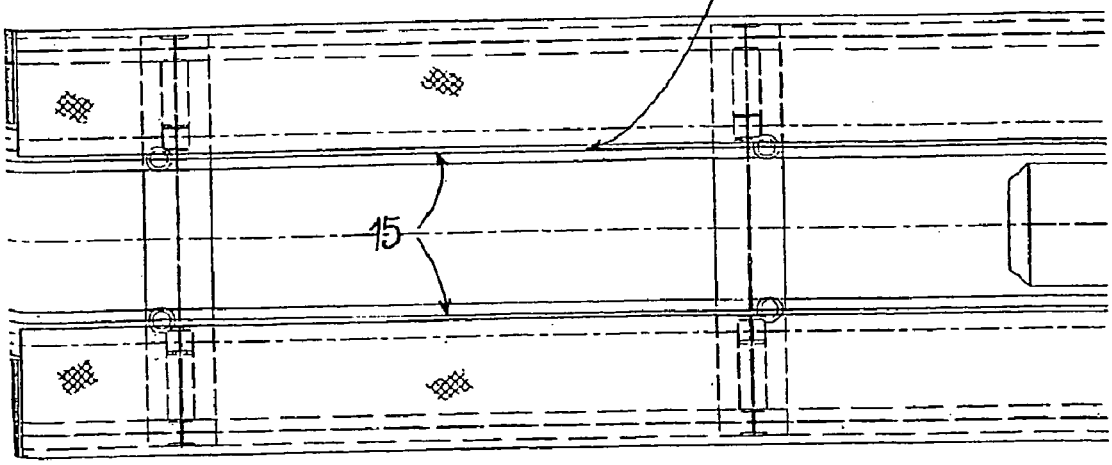

TRANSPORT CAR FOR METAL COILS

BACKGROUND OF THE INVENTION

The invention concerns a transfer car in a conveyance system for metal coils with a chassis that can be moved along a conveyance path by means of a drive and with means for raising and lowering a support saddle along a linear vertical guide on a base frame.

So-called coil transfer cars are used for transporting metal coils in and out, e.g., in strip treatment installations. One well-known design has, for example, a central guide for the support saddle and two hydraulic cylinders for operating the lifting unit.

The guide for the lifting unit can be designed both as a circular guide and as a rectangular guide and generally moves in a guide slot provided for it in the foundation. This slot must be very deep in some cases and requires a reliable cover, possibly with covering elements also carried by the coil transfer car, to prevent accidents.

Another well-known design uses a so-called scissor lifting table for guiding the support saddle and actuating the lifting movement. In this system, the lifting cylinders necessary for lifting act on the scissor system. These coil cars can be built relatively flat, and the opening necessary in the foundation can be correspondingly smaller. However, the unfavorable application of force of the hydraulic cylinders on the scissor system and the nonlinear lifting movement must be seen as disadvantages.

Another well-known variant of these coil transfer cars has a lifting system arranged eccentrically next to the useful load. The advantage of this system lies in the very flat type of construction and in the elimination of the foundation pit. However, the unfavorable application of force and the limited accessibility of the useful load are disadvantages.

The document EP 0 569 719 A1 describes a coil transport system with air cushion vehicles for straight ahead travel and travel around bends, in which the air cushion vehicle has on its longitudinal sides mechanical lateral guides, which can be alternately actuated on the right-hand and left-hand sides, to which guideways are assigned, and these lateral guides allow transverse movement.

The document EP 0 061 557 A2 describes a conveyor for sheet-metal coils, which has a coil car that can be moved along the path of travel by means of a drive. To ensure exact position determination of the coil car on the path of travel, the drive for the coil car consists of a rack that extends along the path of travel and meshes with a drivable gear of the coil car, and the rack serves as an incremental scale for a length-measuring device, which comprises a unit for scanning the incremental scale and at least one counter for counting the output pulses of the scanning unit.

SUMMARY OF THE INVENTION

Proceeding on the basis of the aforementioned prior art, the objective of the invention is to propose an improved design of the transfer car of a conveyance system for sheet-metal coils with a chassis which (chassis) can be moved along the conveyance path, such that this improved design combines the advantages of the aforementioned systems, avoids the specified disadvantages, and, in addition, can be produced inexpensively.

This objective is achieved by the invention with the use, for example, of a steel slab as the plate-like base frame, on which a scissor lifting unit is mounted for the purpose of linear vertical guidance, such that, to raise and lower the support saddle, two lifting cylinders are installed some distance apart as the drive and act directly on the support saddle. Instead of a steel slab, it is also possible to use welded section steel frames as the base frame.

The favorable force application on both sides of the support saddle has an advantageous effect in this design. Furthermore, the device needs no slot guidance in the foundation and, in addition, ensures unrestricted accessibility to the useful load.

It is advantageous for the upper part of the scissor lifting unit to be designed as a support saddle for the useful load.

It is advantageous for the moving part of the scissor lifting unit to be guided, for example, in commercially available linear guides. This results in a guide for the support saddle that is inexpensive, sturdy and suitable for a rolling mill. The entire system consists of only four main parts, namely, the lifting unit, the vertical guide, the running gear, and the hydraulic system. In addition, the lifting movement occurs linearly and independently of the present position of the scissor lifting unit. Accordingly, the scissor system must only take on the task of synchronization and guidance of the support saddle and requires no lifting forces for the guidance. Ideally, systems purchased ready-made and requiring only slight adaptation can be used as the running gear. A version with a separate housing and standard fittings is also possible. An additional advantage results from the fact that the hydraulic cylinders and parts of the hydraulic cylinders are conventional cylinders of a high-pressure class. In this regard, to save construction space and costs, working with high-pressure hydraulics (280 bars) is preferred.

Modifications of the coil transfer car of the invention are specified in the dependent claims.

Additional details, features, and advantages of the invention are described in the following explanation of the specific embodiment that is schematically illustrated in the drawings.

BRIEF DESCRIPTION OF THE DRAWING

FIG. 7 shows a cross section of a takeover station.

FIG. 8 shows a top view of the takeover station.

FIG. 11 shows a travel path in cross section.

FIG. 12 shows a top view of the travel path according to FIG. 11.

DETAILED DESCRIPTION OF THE INVENTION

Figure 1:
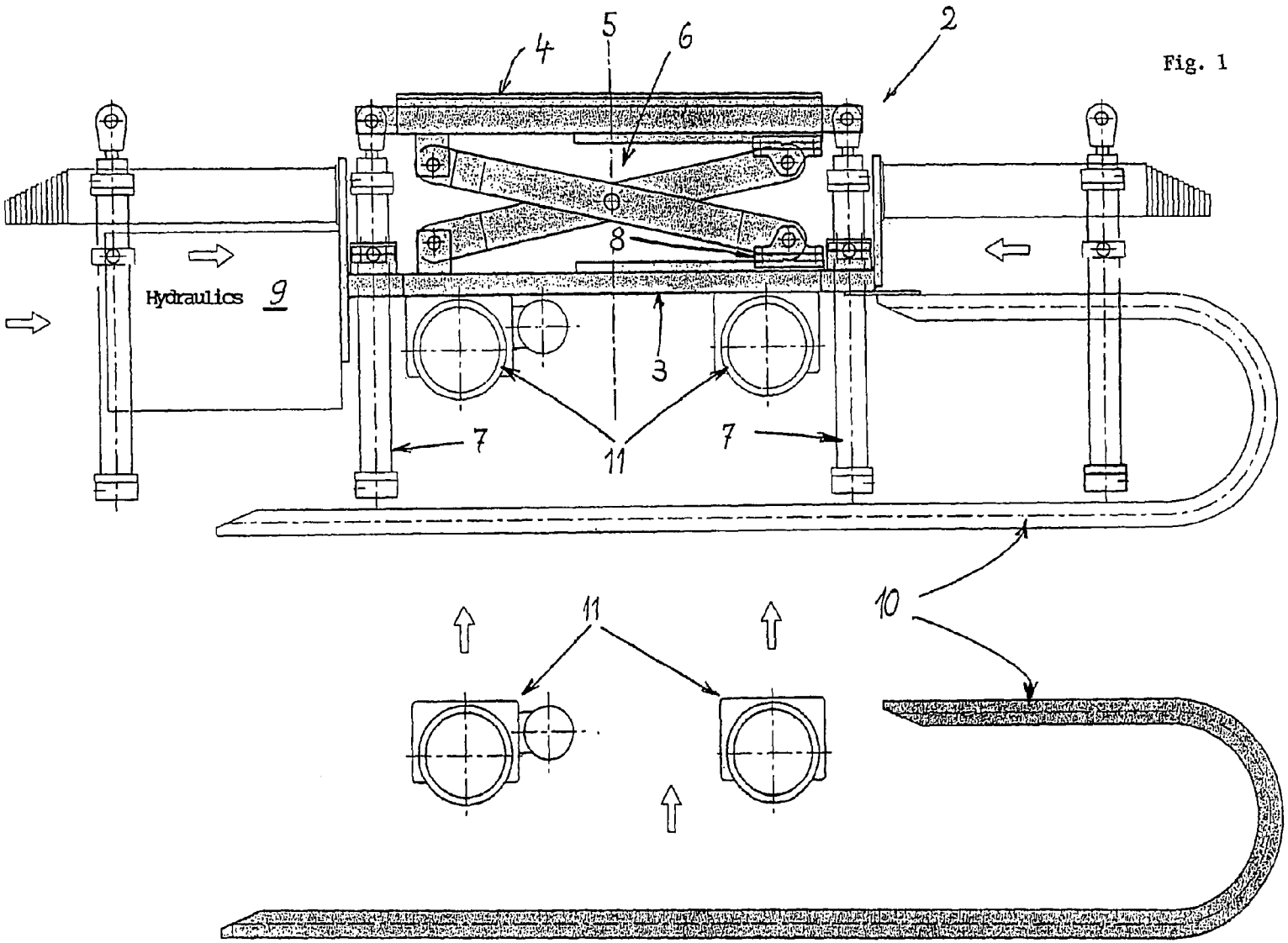
FIG. 1 shows a side view of a transfer car for metal coils in a conveyance system with the associated cable drag chain.
Figure 2:
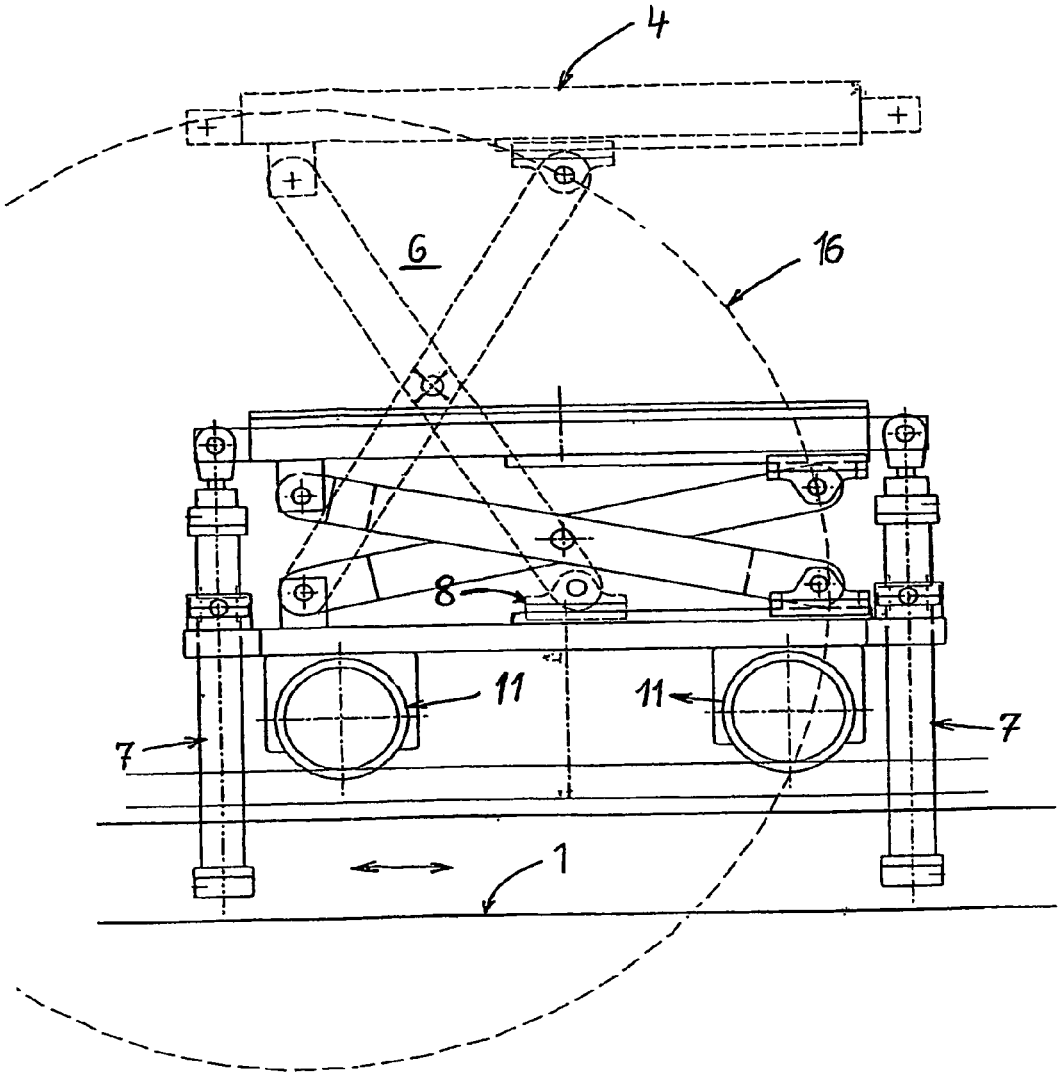
FIG. 2 shows a side view of the transfer car with the raised position of the support saddle indicated by broken lines.
Figures 4, 4A:
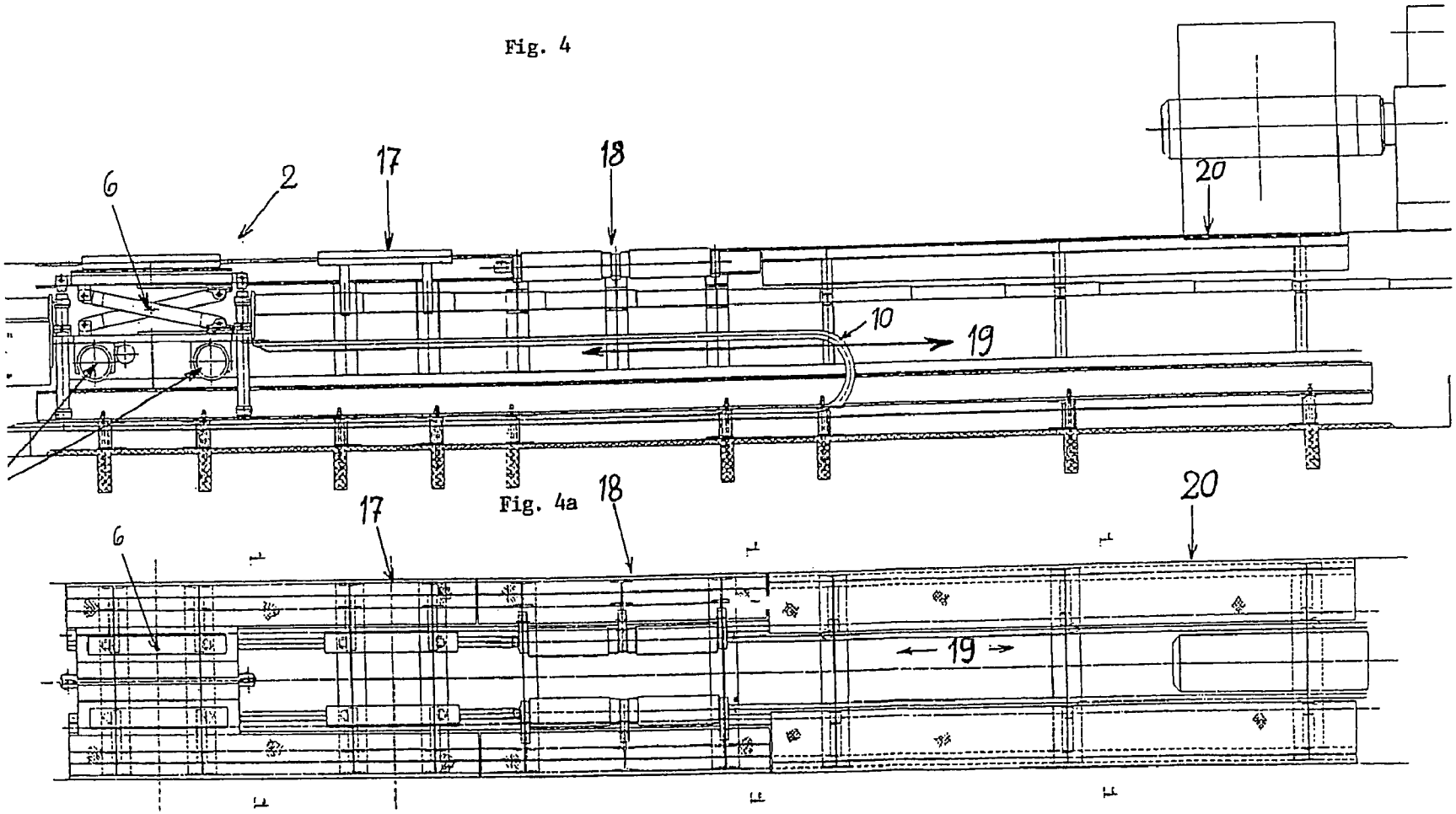
FIG. 4 shows a side view of a complete conveyance system with a coil transfer car and a travel path with coil takeover station, (ground) roller station, and weighing station.
FIG. 4*a* shows a top view of the conveyance system shown in FIG. 4.

FIG. 1 shows a transfer car for metal coils (not shown) in a conveyance system with a chassis 2 that can be moved along a conveyance path 1 by means of a drive and with means for raising and lowering a support saddle 4 along a linear vertical guide 5 on a base frame 3. The conveyance system also comprises a takeover station 17, a ground roller station 18, the travel path 19, and the weighing station 20, as shown in FIG. 4 and FIG. 4*a*. The base frame 3 used here for the coil transfer car is a steel slab, on which a scissor lifting unit 6 is mounted for the purpose of linear vertical guidance 5, such that, to raise and lower the support saddle 4, lifting cylinders 7 are installed some distance apart as the drive and act directly on the support saddle 4. The upper part of the scissor lifting unit 6 is designed as a support saddle 4 for the applied load, for example, for the metal coil. The moving part of the scissor lifting unit 6 is guided on commercially available linear guides by means of sliding blocks 8. This results in a guide for the support saddle 4 that is inexpensive, sturdy, and suitable for a rolling mill. The entire system consists of only four main parts. To operate the lifting unit 6, two hydraulic cylinders 7 act directly on the support saddle 4. The lifting movement thus occurs linearly and independently of the present position of the support saddle 4. In this connection, the scissor system 6 must only take on the task of synchronization and guidance of the support saddle 4 and requires no transmission of lifting forces.

The coil transfer car is equipped with a hydraulic station 9 that moves with it. The hydraulic station 9 is connected to a cable drag chain 10 for power supply.

In addition, running gear 11 equipped with drive mechanisms is installed on the underside of the base frame 3. This results in the advantage that a commercially available system can be used as the running gear.

Figure 3:
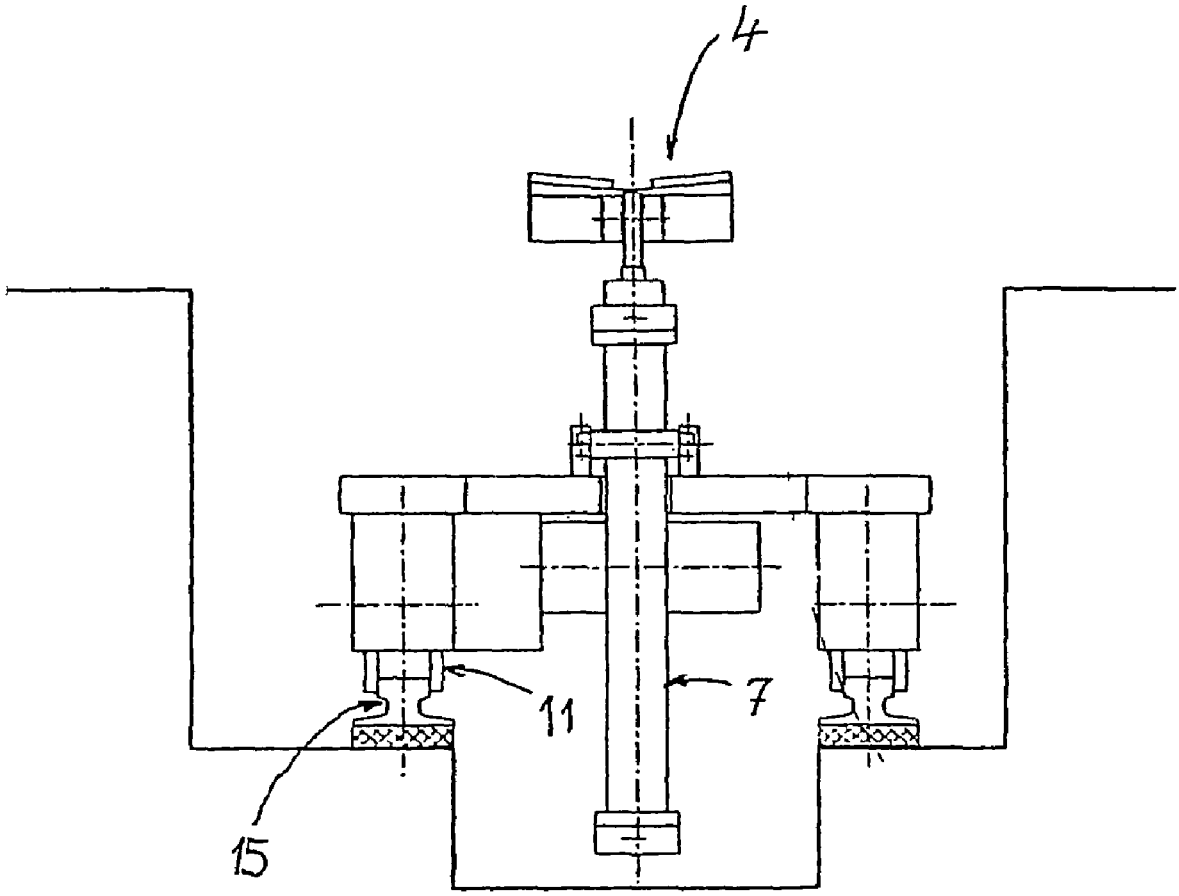
FIG. 3 shows a sectional view of the transfer car in the direction of its horizontal guidance on rails above a foundation pit.

FIG. 3 shows a sectional view of the coil transfer car in the direction of travel with the running gear 11 installed on bilateral rails 15. The drawing also reveals the central arrangement of the lifting cylinders 7 and their assembly with one support saddle 4 each. The drawing effectively shows the relatively low design of the transfer car, which requires only centrally a relatively shallow lift shaft in the foundation with optimum accessibility of its functional elements.

FIG. 4 shows a general layout of the conveyance system with the travel path 19 and the coil transfer car at the left end of the travel path 19 in a side view. The scissor lifting unit 6 and the traversing unit 11 of the transfer car are also shown. The conveyance system comprises the takeover station 17, the ground, roller station 18, the travel path 19 with cable drag chain 10, and the weighing station 20 at the end. FIG. 4*a* shows the entire system in a top view. The coil transfer car has a hydraulic station 9 that is permanently mounted on it and moves with it. The hydraulic station 9 is conductively connected with the cable drag chain 10 for the purpose of power supply. In the case of relatively large lifting distances, the length of the lifting cylinder determines the overall height of the total system. To avoid the large overall heights of the lifting cylinders that this would entail, the invention provides the arrangement and design of the lifting system with a dual cylinder system that are shown purely schematically in FIG. 5. Together with the guidance of the support saddle 4 on a scissor lifting unit 6, this results in comparatively low overall heights.

Figure 5:
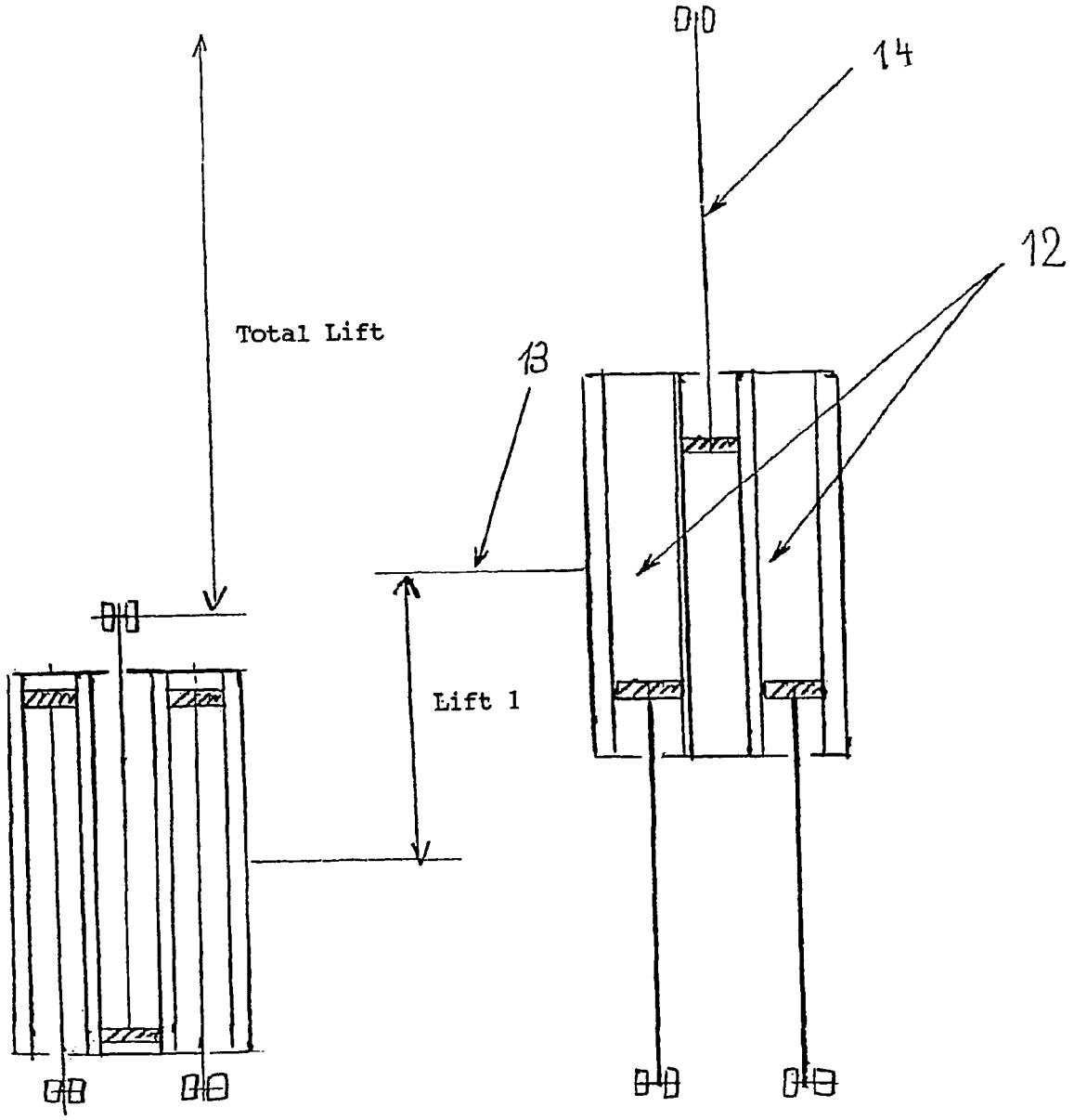
FIG. 5 shows a schematic diagram of dual cylinder systems for an especially large lifting height.
Figure 6:
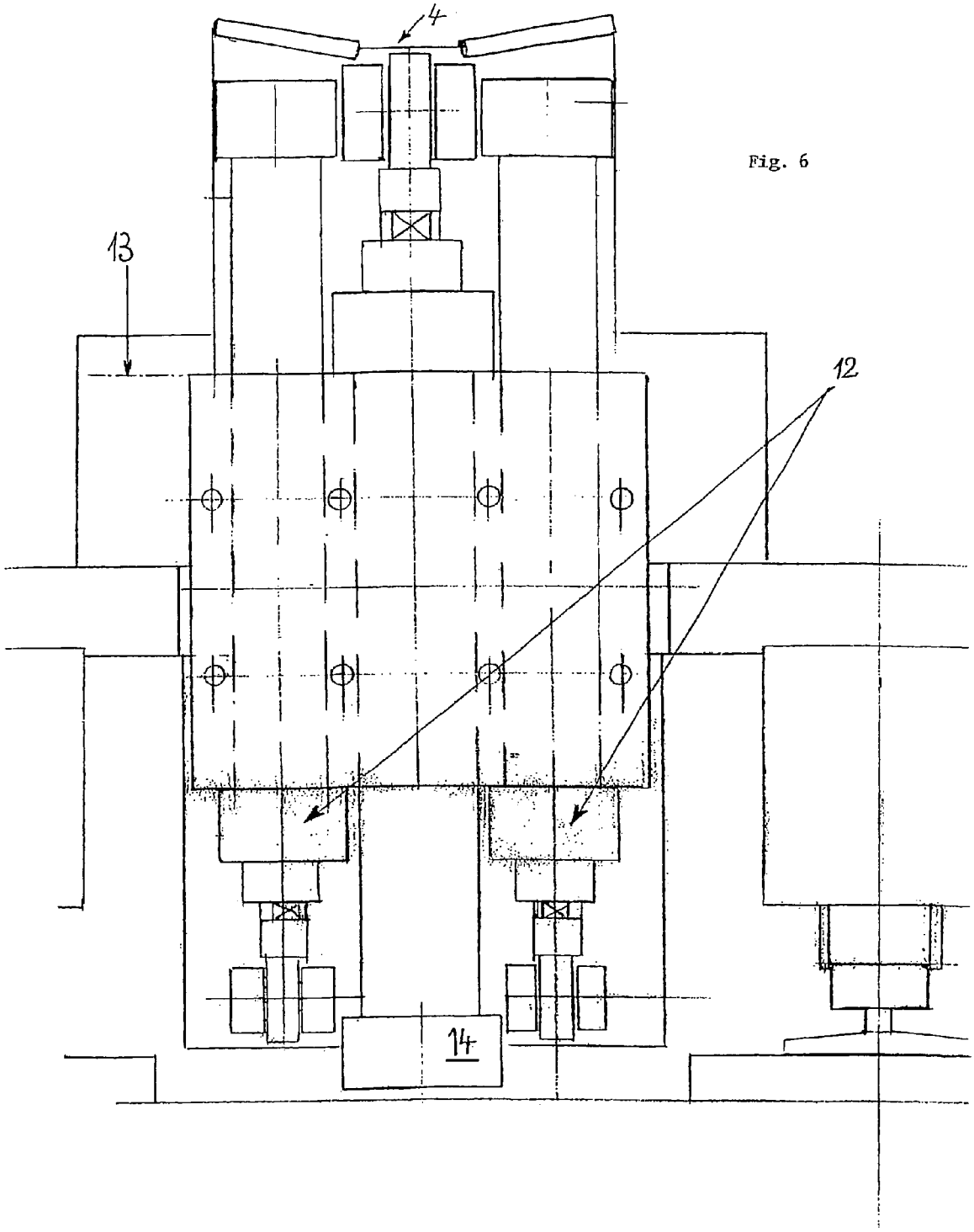
FIG. 6 shows an enlarged side view of the cylinder system shown in FIG. 5.

With a conventional arrangement of the cylinders, the path required for the lift must be fully available in the cylinder. Therefore, the lifting height determines the overall height of the coil transfer car if the overall length of the cylinder exceeds the overall height of the car. As shown in FIG. 5, as a result of the arrangement in accordance with the invention of the dual hydraulic cylinders 12 and the telescopic cylinders 14, individual lifts of two or more cylinders are nested in one another in such a way that a total lift according to the schematic drawing in FIG. 5 is obtained with uncomplicated means. When the support saddle is to be raised, first a row of cylinders 12 is extended. With the cylinders 12 in their upper position 13, the second row of cylinders 14 is then extended further until the total lift is reached. As the drawing in FIG. 5 shows, this results in a compact arrangement of the lifting cylinders. FIG. 6 shows the arrangement of telescopic cylinders 14 of the dual cylinder system 12 during the extension from the upper position 13 of the dual cylinder system 12. FIG. 7 shows a cross section of a takeover station 17 with the load in the form of the sheet-metal coil 16 on the support saddle 4. The lowered position of the support saddle 4 is indicated by the solid-line arrow 4, and the raised position of the support saddle 4 is indicated by the broken-line arrow 4. FIG. 8 shows a top view of the takeover station 17 with the arrangement of the lifting cylinders 7 in the center plane of the transfer car.

Figure 9:
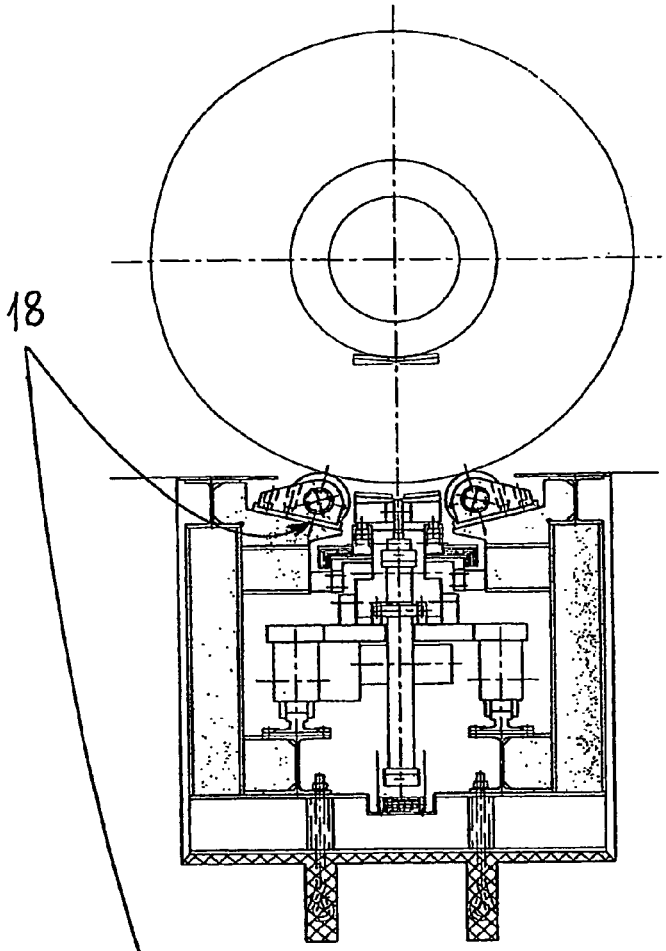
FIG. 9 shows a cross section of a ground roller station.
Figure 10:
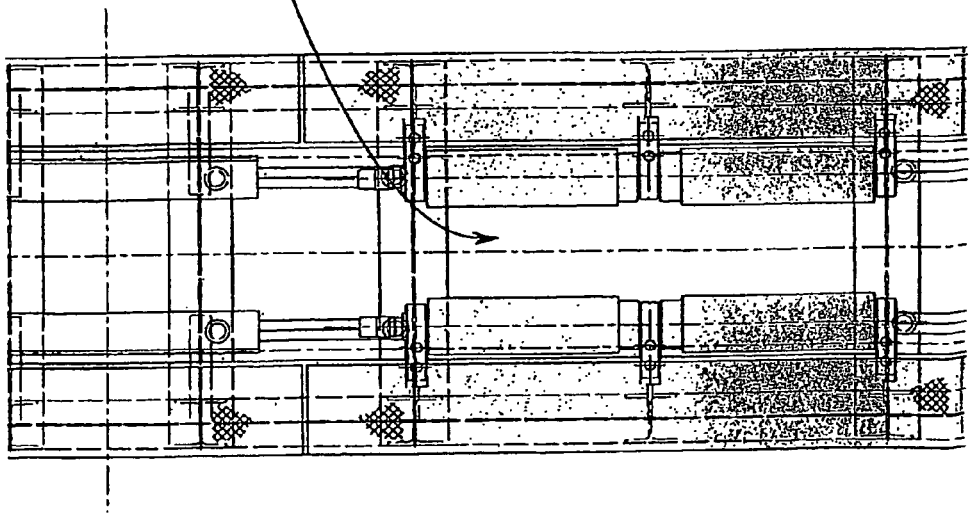
FIG. 10 shows a top view of the ground roller station.

The design of a ground roller station 18 is shown in FIGS. 9 and 10 in a cross-sectional view and a top view, respectively.

Figure 13:
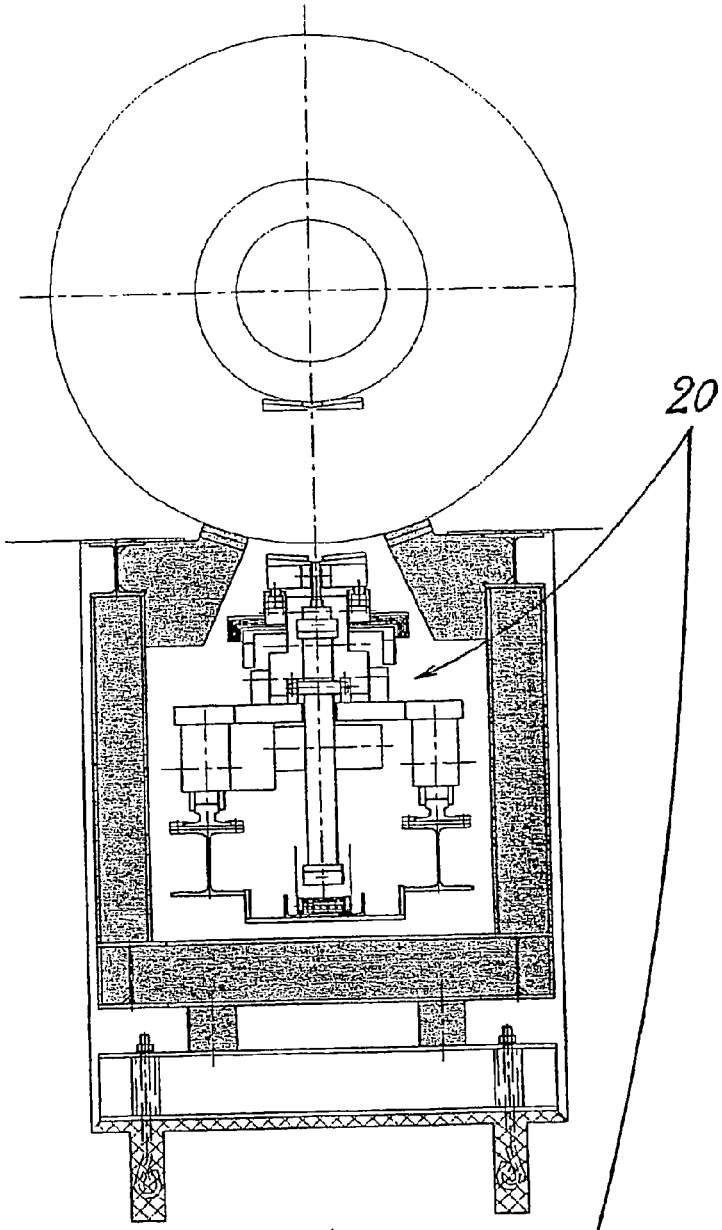
FIG. 13 shows a weighing station in cross section.
Figure 14:
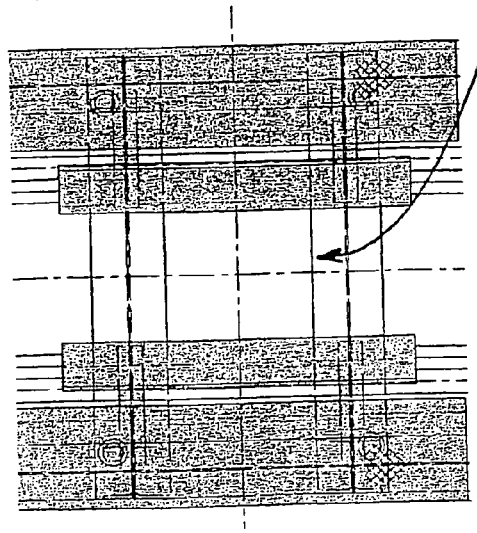
FIG. 14 shows a top view of the weighing station.

Finally, the transport system has a weighing station 20, which is located at the end of the travel path 19. The travel is shown in a cross-sectional view and a top view in FIGS. 11 and 12, respectively, and the weighing station 20 is shown in a cross-sectional view and a top view in FIGS. 13 and 14, respectively.

| List of Reference Numbers | |
|---|---|
| 1 | conveyance path |
| 2 | chassis |
| 3 | base frame |
| 4 | support saddle |
| 5 | vertical guide |
| 6 | scissor lifting unit |
| 7 | lifting cylinder |
| 8 | sliding block |
| 9 | hydraulic station |
| 10 | cable drag chain |
| 11 | running gear |
| 12 | dual cylinder system |
| 13 | upper position (of cylinders 12) |
| 14 | telescopic cylinder |
| 15 | rail |
| 16 | load (sheet-metal coil) |
| 17 | takeover station |
| 18 | ground roller station |
| 19 | travel path |
| 20 | weighing station |

The invention claimed is:

1. Transfer car in a conveyance system for metal coils, having a support saddle, a chassis (2) that can be moved along a conveyance path (1) by means of a drive and means for raising and lowering the support saddle (4) along a linear vertical guide (5) on a base frame (3) shaped as a plate, wherein a steel slab is used as the plate-shaped base frame (3), on which a scissor unit (6) is mounted for the purpose of linear vertical guidance (5) and so as to not take on any lifting forces, two lifting cylinders (7) are installed a distance apart as the drive and act directly on the support saddle (4) to provide the sole lifting forces to raise and lower the support saddle (4).

2. Coil transfer car in accordance with claim 1, wherein a telescoping dual cylinder system (12) is provided so as to initially provide half the lifting height and, a following upper arrangement (13) supported by the dual cylinder system (12)

and having one telescopic cylinder (14) that is extendable until an intended total lift is reached.

3. Coil transfer car in accordance with claim 1, wherein the support saddle (4) forms an upper part of the scissor unit (6).

4. Coil transfer car in accordance with claim 1, wherein the scissor unit (6) has sliding blocks (8) which are horizontally guided on the base frame (3) in linear guides.

5. Coil transfer car in accordance with claim 1, wherein running gear (11) equipped with driving mechanisms is installed on an underside of the base frame (3).

6. Coil transfer car in accordance with claim 1, wherein the cylinders are cylinders (7) of a high-pressure class.

* * * * *